US005967694A

United States Patent [19]

Covarrubias et al.

[11] Patent Number: 5,967,694

[45] Date of Patent: Oct. 19, 1999

[54] PORTABLE ROADWAY AND METHOD OF ASSEMBLING SAME

[75] Inventors: Nelson Covarrubias, Edo. Monagas; Pierre Miura, Monagas; Jose Luis Mayor, Edo. Monagas; Juan Federico Urich, Monagas, all of Venezuela

[73] Assignee: Intevep, S.A., Caracas, Venezuela

[21] Appl. No.: 09/014,513

[22] Filed: Jan. 28, 1998

[51] Int. Cl.[6] ..... E01C 3/00; E01C 5/00; E01C 19/00; E01D 15/14

[52] U.S. Cl. ..... 404/28; 404/27; 404/31; 404/73; 404/82; 14/2.6; 14/27

[58] Field of Search ..... 14/2.6, 27, 73; 404/27, 28, 29, 31, 73, 82; 405/138, 146, 229

[56] References Cited

U.S. PATENT DOCUMENTS

| | | | |
|---|---|---|---|
| 163,758 | 5/1875 | Filbert et al. | 404/29 |
| 744,541 | 11/1903 | Heenan | 404/27 |
| 791,137 | 5/1905 | Cudell | 404/27 |
| 1,215,537 | 2/1917 | Hyatt | 14/73 |
| 1,402,942 | 1/1922 | Margetts | 404/82 |
| 3,427,936 | 2/1969 | Van Der Meijden | 404/73 |
| 4,300,320 | 11/1981 | Rooney | 52/173 R |
| 4,797,026 | 1/1989 | Webster | 404/28 |
| 5,471,694 | 12/1995 | Meheen | 14/73 |
| 5,730,548 | 3/1998 | Brero et al. | 404/27 |

*Primary Examiner*—Thomas B. Will
*Assistant Examiner*—Gary S. Hartmann
*Attorney, Agent, or Firm*—Bachman & Lapointe, P.C.

[57] ABSTRACT

In accordance with the present invention, a roadway for supporting vehicular traffic and which can be used over a wide variety of terrains comprises a network of interconnected modular components for supporting a road bed over which vehicles can travel and a plurality of prefabricated panels, overlaying the network of interconnected modular components, which form a road bed. The network of interconnected modular components includes a first layer of interconnected, prefabricated concrete cylinders placed over the terrain to be traversed. The concrete cylinders are formed into a number of rows whose longitudinal axes are parallel to the direction of the road. The network further includes a second layer of interconnected, prefabricated concrete cylinders placed over the first layer and joined to the first layer by a number of intermediate support devices. The concrete cylinders in the second layer have their longitudinal axes extending in a direction substantially perpendicular to the direction of the road. After the second layer has been assembled, a number of prefabricated panels are positioned over the second layer. The prefabricated panels are formed into two spaced apart rows which extend in the direction of the road. Each of the prefabricated panels has a substantially planar surface which forms at least a portion of the road bed over which the vehicles can traverse and a vertically extending safety wall. A method for assembling the roadway of the present invention is also disclosed.

22 Claims, 8 Drawing Sheets

PORTABLE ROADWAY AND METHOD OF ASSEMBLING SAME

BACKGROUND OF THE INVENTION

The present invention relates to a temporary or a permanent roadway for accommodating vehicular traffic and to a method for constructing said roadway.

In the drilling of oil wells or in the search for oil fields or in the repair of different devices in remote areas, it is very difficult to enable trucks and other heavy equipment to transport the necessary apparatus and equipment to the desired site because of poor ground conditions. For example, if the ground is too wet, trucks and heavy equipment cannot traverse the ground. In the past, this problem has been dealt with by laying down gravel, shale or the like or, alternatively, by laying down a series of boards to form a road. These approaches are extremely labor intensive and expensive. Further, there is the constant problem of repair to the temporary road. Additionally, it is difficult to remove the boards if one is damaged and needs to be replaced. Thus, a better approach to forming a road to support vehicles and heavy equipment is needed.

The patent literature contains a number of patents directed to portable roadways for allowing vehicles to traverse various types of terrain. U.S. Pat. No. 3,859,000 to Webster, U.S. Pat. No. 4,097,948 to Finsterwalder, U.S. Pat. No. 4,376,596 to Green, U.S. Pat. No. 5,163,776 to Pouyer, and U.S. Pat. No. 5,495,631 to Connor exemplify these portable roadways. It is also known in the patent literature to form a variety of different support structures from concrete. U.S. Pat. No. 4,318,362 to Jung, U.S. Pat. No. 4,958,964 to Soto et al., and U.S. Pat. No. 5,050,524 to Kyhl et al. exemplify floating docks and pavements formed from concrete.

There remains a need however for a roadway which can be easily constructed by using a minimal number of modular elements and which requires minimal disturbance to the terrain over which the roadway will pass. There is also needed a temporary roadway which can support heavy loads, up to 100 tons. Still further, there is a need for a roadway which can be easily disassembled and whose elements can be reused.

SUMMARY OF THE INVENTION

Accordingly, it is an object of the present invention to provide a roadway which can support vehicular traffic and which can be easily constructed from a minimal number of components.

It is a further object of the present invention to provide a roadway as above which can be assembled with a minimal environmental impact.

It is still a further object of the present invention to provide a roadway as above which is capable of supporting very heavy loads.

It is yet a further object of the present invention to provide a roadway as above which can be assembled from prefabricated concrete modules.

It is also a further object of the present invention to provide a method for assembling a roadway as above.

The foregoing objects are attained by the roadway and the roadway assembly method of the present invention.

In accordance with the present invention, a roadway for supporting vehicular traffic and which can be used over a wide variety of terrains comprises a network of interconnected modular components which form a means for supporting a road bed over which vehicles can travel and a plurality of prefabricated panels, overlaying said network of interconnected modular components, which form at least a portion of the road bed.

The network of interconnected modular components includes a plurality of prefabricated, concrete cylindrical members and a number of connecting devices. The network includes a first layer of interconnected, prefabricated concrete cylindrical members which are placed over the terrain to be traversed. The concrete cylindrical members are formed into a number of rows whose longitudinal axes are parallel to the direction of the roadway. The network further includes a second layer of interconnected, prefabricated concrete cylindrical members placed over the first layer and joined to the first layer by a number of intermediate support devices. The concrete cylindrical members in the second layer have their longitudinal axes extending in a direction substantially perpendicular to the direction of the roadway. After the second layer has been assembled, a number of prefabricated panels are positioned over the second layer. The prefabricated panels are formed into two spaced apart rows which extend in the direction of the road. Each of the prefabricated panels has a substantially planar surface which forms at least a portion of the road bed over which vehicles can traverse and a vertically extending wall.

The method for assembling the roadway of the present invention comprises forming a first roadway support layer over a particular terrain to be traversed, the first layer forming step comprising forming a plurality of rows of cylindrical members with each row extending in a first direction, forming a second roadway support layer over the first roadway support layer, the second layer forming step comprising forming a plurality of rows of cylindrical members, which rows extend in a second direction substantially perpendicular to the first direction, and forming a roadbed over the second layer by positioning two spaced apart rows of roadbed panels over the second layer with each row extending in the first direction.

Other details of the roadway and the method of the present invention, as well as other objects and advantages attendant thereto, are set forth in the following detailed description and the drawings appended hereto in which like reference numerals depict like elements.

DETAILED DESCRIPTION OF THE PREFERRED EMBODIMENT(S)

Figure 1:
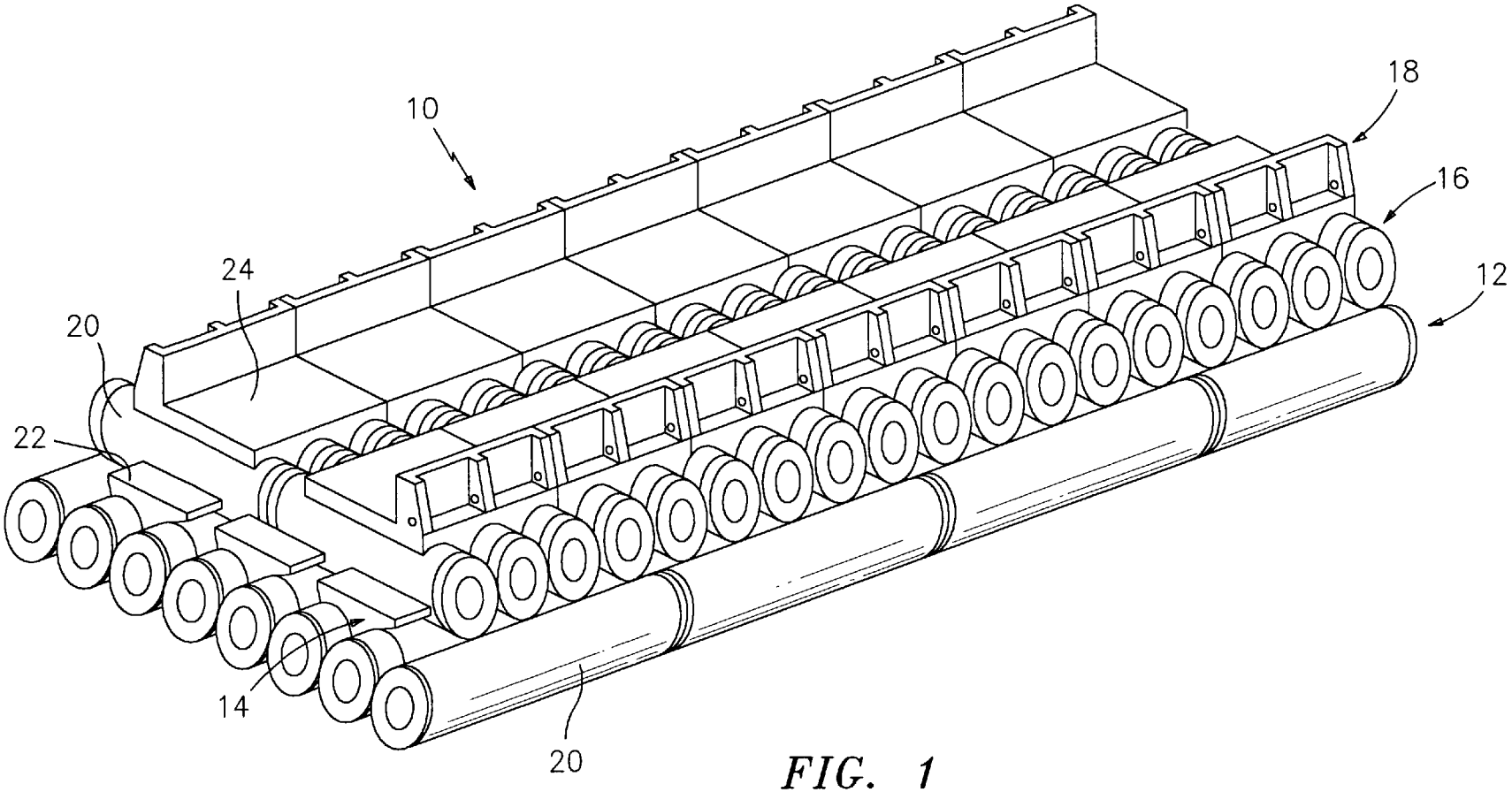
FIG. 1 is an isometric view of the roadway of the present invention.
Figure 2:
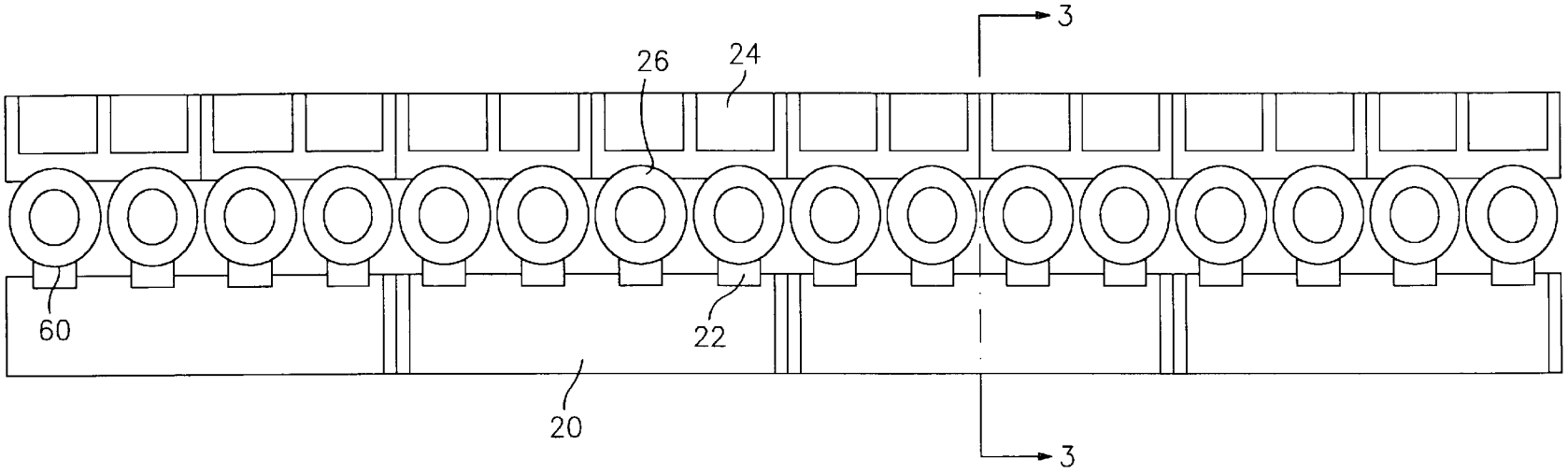
FIG. 2 is a side view of the roadway of the present invention.
Figure 3:
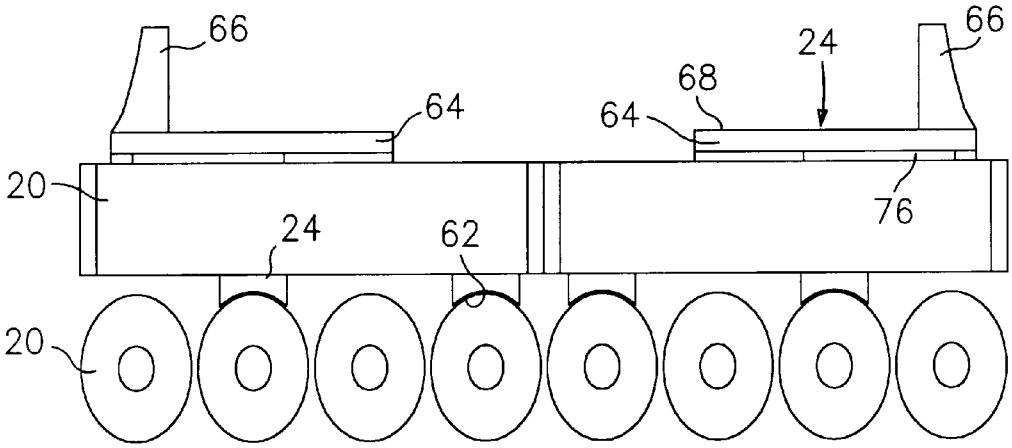
FIG. 3 is a sectional view of the roadway of the present invention taken along lines 3—3.

Referring now to the drawings, FIGS. 1 to 3 illustrate a portion of a roadway 10 formed in accordance with the present invention. As shown in these figures, the roadway 10 consists of a plurality of interconnected layers 12, 14, 16, and 18 of prefabricated structures.

The layer 12 comprises a plurality of rows of interconnected cylindrical members 20 whose longitudinal axes all extend in the direction of the roadway. The layer 14 consists of a plurality of connecting members 22 used to join the layer 16 to the layer 12. The layer 16 comprises rows of two or more cylindrical members 20 joined together and oriented so that their longitudinal axes are substantially perpendicular to the direction of the roadway 10. The layer 18 is positioned over the layer 16 and consists of two, spaced apart rows 26 and 28 of road bed panels 24 with each of the rows 26 and 28 extending in the direction of the roadway 10.

The number of rows of cylindrical members 20 in the layer 12 and the number of cylindrical members 20 in each row of the layer 16 are determined by the desired width for the roadway. The number of rows in the layer 16 are of course determined by the desired length of the roadway.

Figure 4:
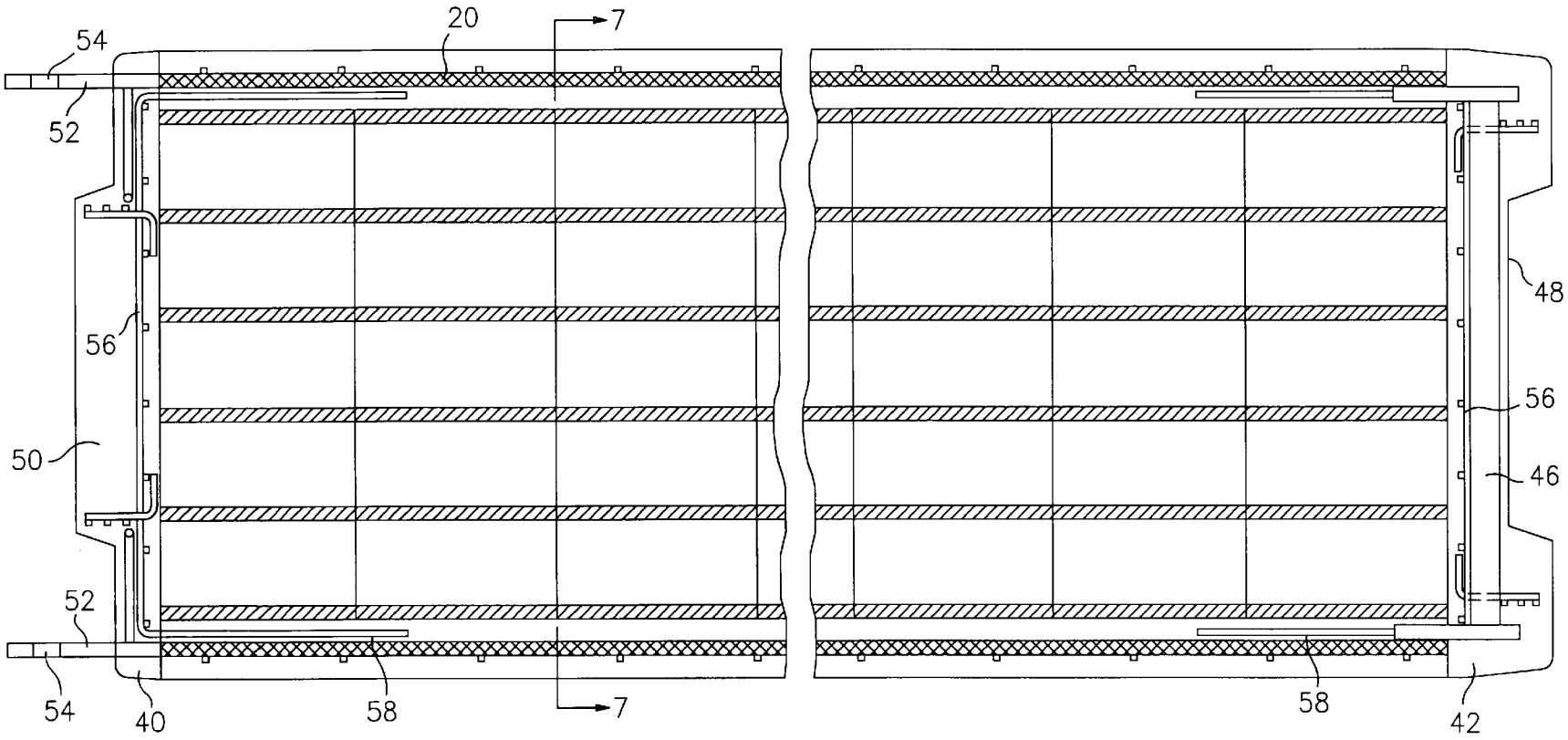
FIG. 4 is a longitudinal sectional view of one of the cylindrical members used in forming the roadway of the present invention.
Figure 7:
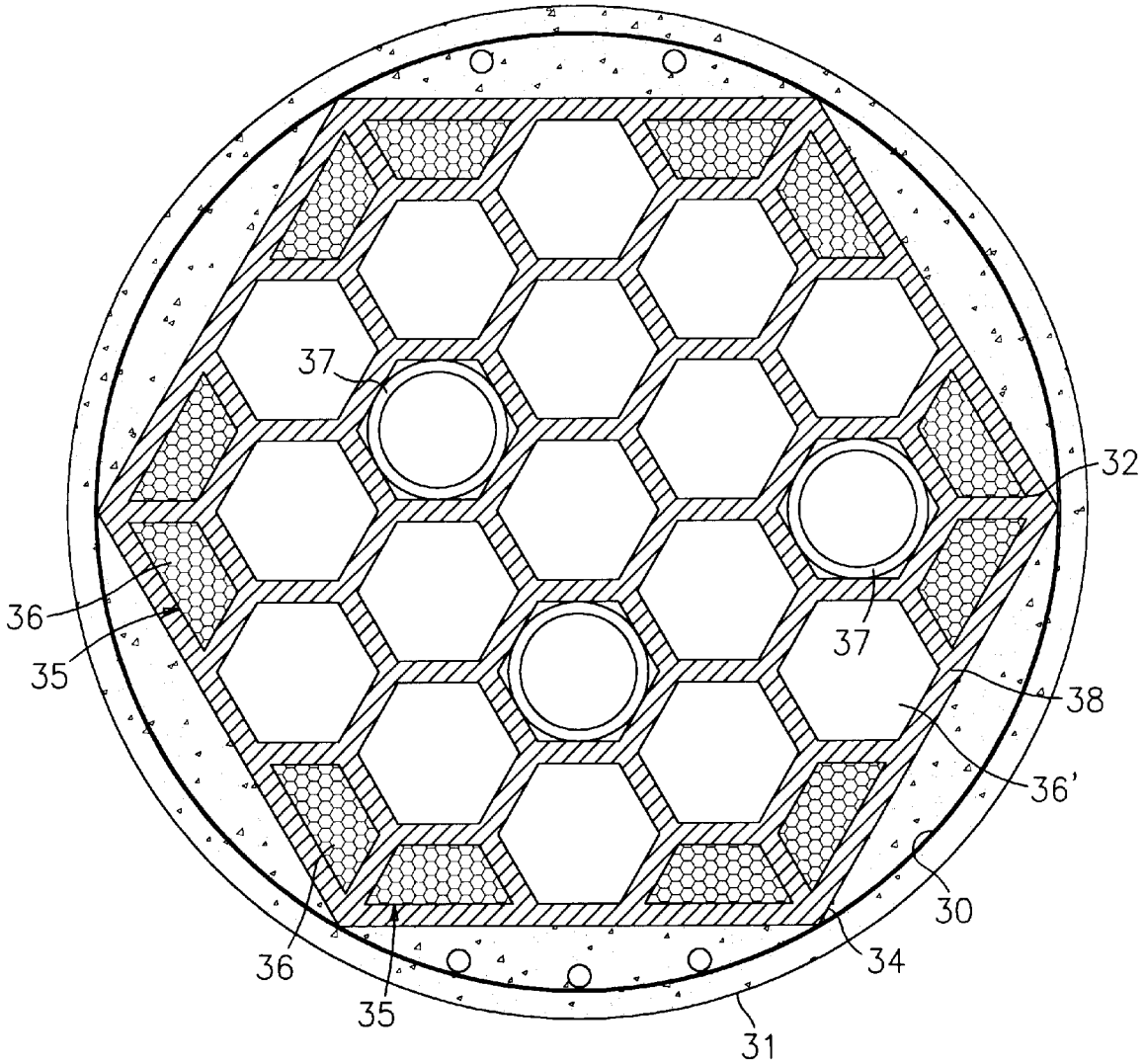
FIG. 7 is a sectional view of the cylindrical member of FIG. 4 showing the internal hexagonal reinforcing member taken along line 7—7.

One of the cylindrical members 20 used to form the layers 12 and 16 is illustrated in FIG. 4. The cylindrical member 20 comprises a prefabricated, concrete tube having any desired length and any desired diameter. As shown in FIG. 7, the member 20 preferably has a circular outer surface 31 and an inner surface 30, formed from a circular reinforced steel wire mesh, which defines a central bore. Positioned within the bore defined by the inner surface 30 are a number of hexagonally shaped, internal reinforcing members 32, preferably formed from concrete. As can be seen in FIG. 7, each reinforcing member 32 is dimensioned so that the corners 34 contact the inner surface 30 forming the bore. If desired, a granular material 36 such as polystyrene may be used to fill interstices or voids 35 formed in the reinforcing member adjacent the corners 34. Other interstices or voids 36' in the member 32, preferably all, may be filled with inflatable polyethylene tubes or hoses 37. Before placing the caps 40 and 42 on the ends of the cylindrical members 20, each of the hoses 37 is inflated with air so as to form air chambers which help prevent the ingress of water into the cylindrical member. The resultant cylindrical members possess buoyant properties which allow them to float on soft, watery or marsh-like terrains. After a number of the reinforcing members 32 have been placed in the cylindrical members 20, the space between the outer surface 31 and the sidewalls 38 is filled with concrete. The steel wire mesh 31 adds strength to the concrete.

Figure 5:
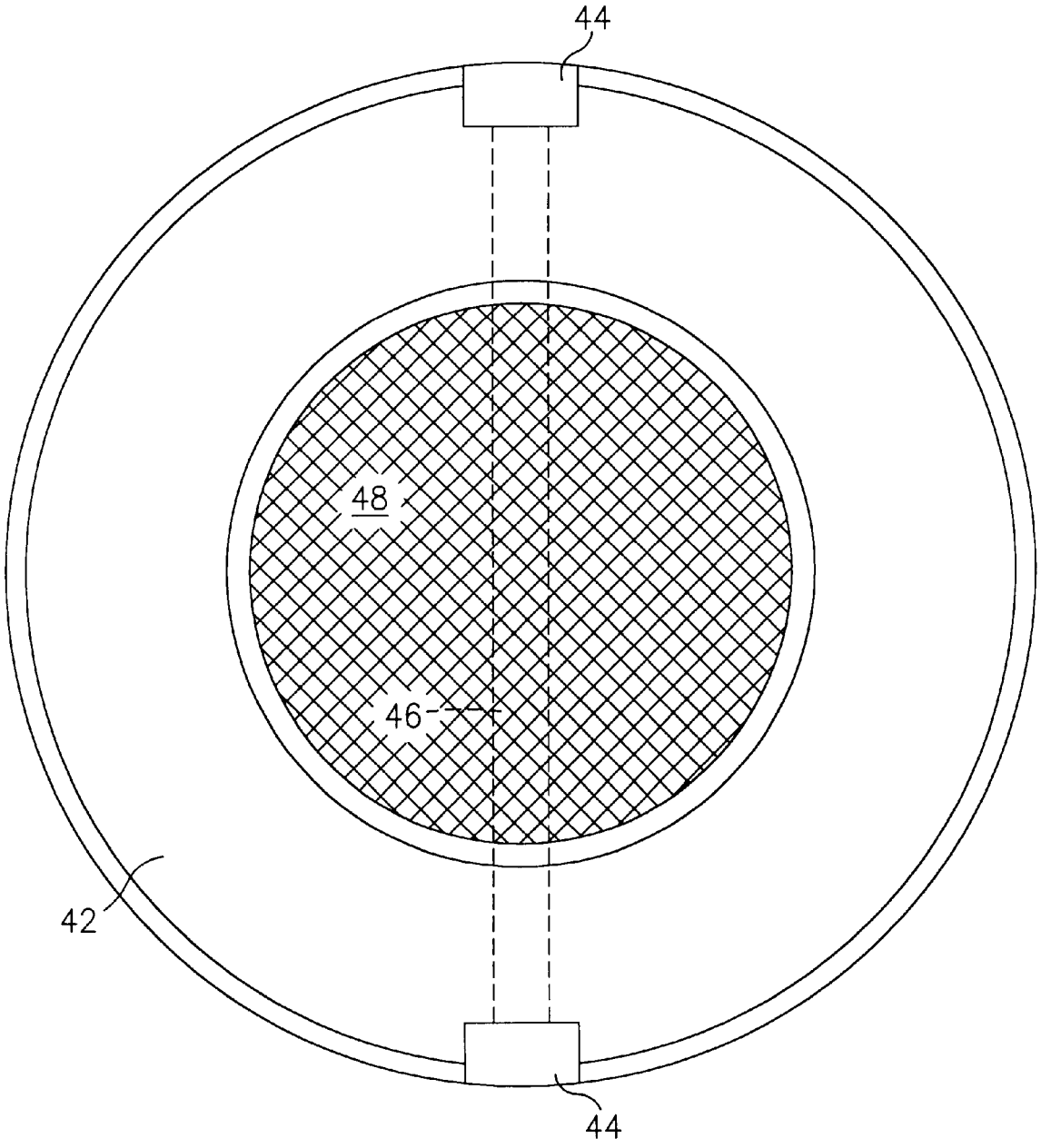
FIG. 5 is an end view of a first end of the cylindrical member of FIG. 4 illustrating the female connection element.
Figure 6:
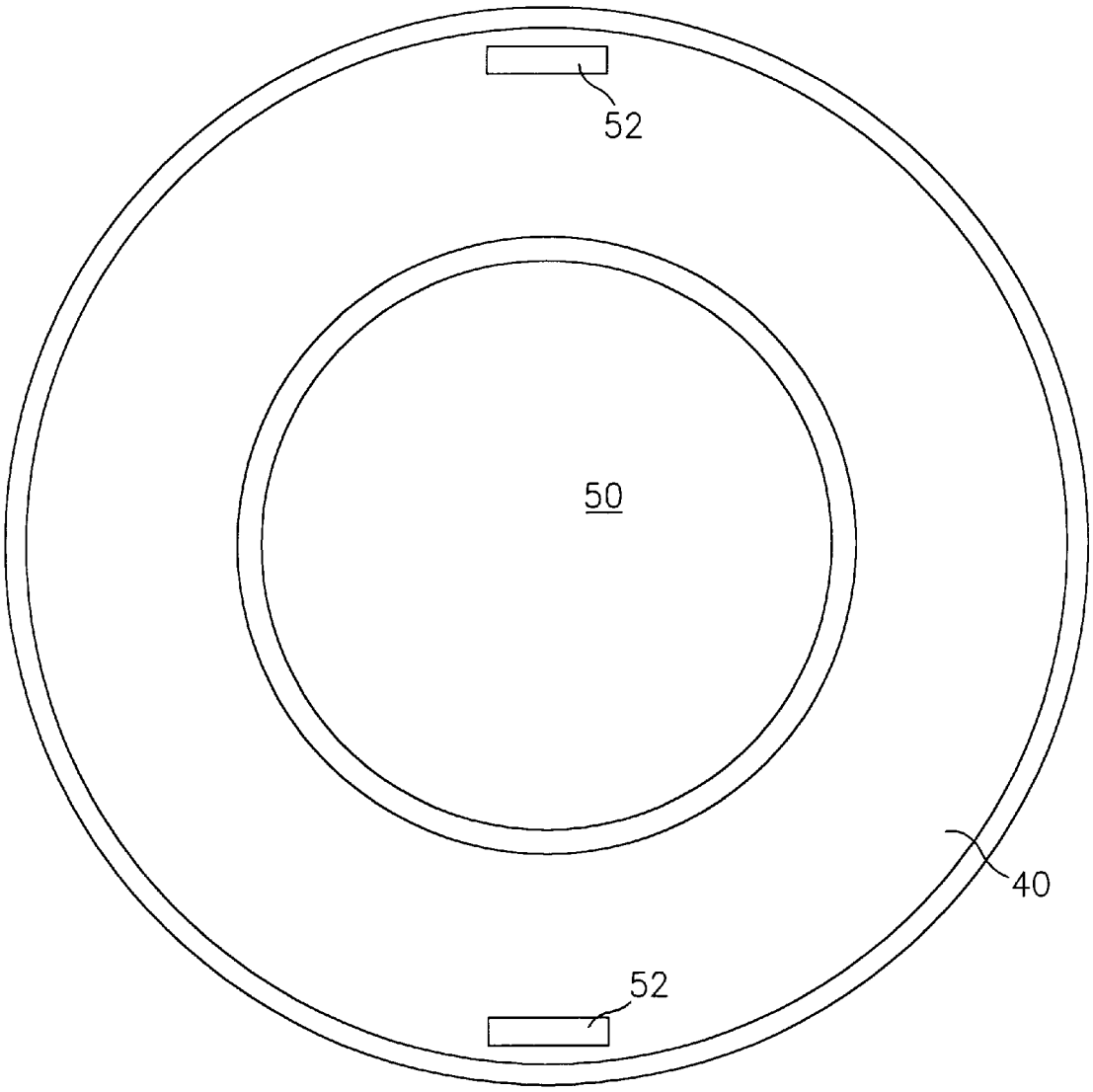
FIG. 6 is an end view of a second end of the cylindrical member of FIG. 4 illustrating the male connection element.

Referring now to FIGS. 4 to 6, the cylindrical members 20 are provided with a first cap 40 with a male connecting member at one end and a second cap 42 with a female connecting member at a second end. The caps 40 and 42 may be joined to the cylindrical members 20 in any desired manner. Preferably, the caps 40 and 42 with the connecting members respectively are also made from prefabricated concrete.

As shown in FIGS. 4 and 5, the cap 42 has two notches 44 spaced 180 degrees apart. A diametrical passageway 46, preferably formed from a metal tube, extends from one notch 44 to the other notch 44. The female connecting member is configured to have a cavity 48 for receiving a corresponding male core member 50.

The cap 40 having the male connecting member is shown in FIGS. 4 and 6. As shown therein, the connecting member is configured to have a centrally positioned core member 50. The cap 40 includes two spaced apart, integrally formed, metallic connecting flanges 52. The connecting flanges 52 each have a width which corresponds to the width of the notches 44 and an aperture 54 which aligns with the passageway 46. When two cylindrical members 20 are joined together, a connecting pin (not shown) extends through the aligned apertures 54 and the passageway 46 to secure the two cylindrical members together.

Each of the caps 40 and 42 when formed includes a metallic ring 56 incorporated or embedded therein. The ring 56 has a plurality of radially spaced metallic rods 58 for securing the respective caps 40 and 42 to the respective ends of a cylindrical member 20. Typically, the caps 40 and 42 are positioned at the respective ends before the concrete poured into the spaces between the sidewalls 38 and the outer surface 31 sets. This allows the setting concrete to secure the caps 40 and 42 in place by setting up around the rods 58.

As previously mentioned, the layer 12 is formed by rows of cylindrical members 20 which have been connected together via adjacent ones of the male and female connectors and by the pin connectors. After the rows have been positioned, a number of connecting members 22 are placed over the cylindrical members 20. As shown in FIG. 2, the connecting members 22 are spaced so as to receive the rows of cylindrical members forming the layer 16. Also, as shown in this figure, the upper surfaces 60 of the members 22 are arcuately shaped to receive a lower portion of one of the cylindrical members 20 forming the rows in the layer 16. As shown in FIG. 3, the lower surfaces 62 of the connecting members 22 are also arcuately shaped so as to fit over the curved surfaces of one of the cylindrical members in the layer 12. The connecting members 22 may be joined to the cylindrical members in the layer 12 in any desired manner. The members 22 are held in place by the weight of the cylindrical members 20 and the concave-convex mating shapes of the members 20 and 22.

Once the connecting members 22 have been positioned, the rows of connected cylindrical members forming the layer 16 are placed in position. As previously discussed, each row in the layer 16 is formed by two or more cylindrical members 20. The cylindrical members 20 in these rows are identical to the cylindrical members 20 in the layer 12. The cylindrical members 20 in each row are connected by the previously discussed male and female connecting members and connecting pin(s).

Figure 8:
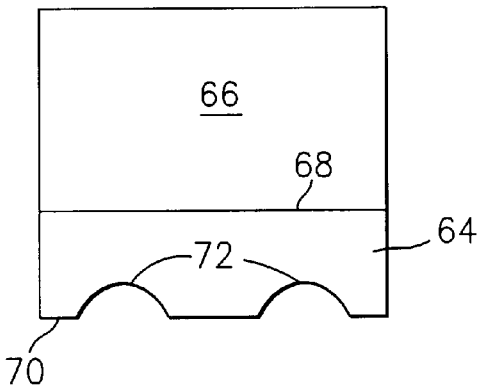
FIG. 8 is a side view of one of the panels used to form the road bed.
Figure 9:
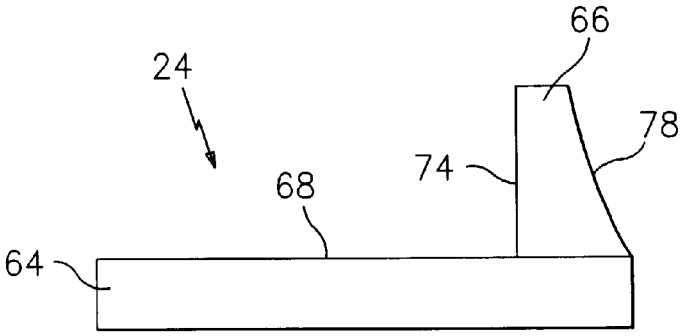
FIG. 9 is an end view of the panel of FIG. 8.

After the second layer 16 has been formed, two spaced apart rows of road bed panels 24 are installed over the cylindrical members 20. The road bed panels 24 are illustrated in FIGS. 8 and 9. As shown therein, each panel has an L-shaped configuration formed by a horizontal member 64 and a vertical member 66. The two members may be preformed members which are joined together or alternatively can be a single integrally formed member. Preferably, the horizontal member 64 and the vertical member 66 are formed from concrete.

The horizontal member 64 has a substantially planar upper surface 68 and a lower surface 70 with two arcuately shaped cut-out portions 72. Each portion 72 is designed to fit over an upper portion of one of the cylindrical members 20 in the layer 16. By providing two cut-out portions, two adjacent rows of cylindrical members in the layer 16 can be joined together.

The vertical member 66 preferably has a substantially planar interior wall 74. The outer wall 78 of the member 66 may have any desired configuration.

If desired, a non-slip or stress diffusion material 76 may be positioned between the upper surface of the cylindrical members 20 to be joined together and the respective cut-out portions 72. Any suitable non-slip or stress diffusion material known in the art may be utilized to prevent slippage of the panels 24 relative to the cylindrical members forming the rows of the layers 16.

The substantially planar portions 68 of the panels 24 may form the roadway over which the vehicles travel. Alternatively, a layer of panels, such as metal panels or wood panels (not shown), may be placed over the portions 68 to further form the roadway 10.

In order to assemble a roadway in accordance with the present invention, a number of concrete cylindrical members 20 are fabricated by placing hexagonally shaped, preformed concrete, internal reinforcing members 32 in a steel cylindrical mold whose inner surface defines the outer surface 31 for the members 20 and thereafter pouring concrete into the spaces between the sidewalls 38 of the reinforcing members 32 and the surface 31. While the poured concrete is still wet, caps 40 and 42 respectively having male and female connecting members 40 and 42 are moved into position at opposite ends of the cylindrical members 20. The caps 40 and 42 are held in position by inserting a plurality of metal rods into the wet, setting concrete.

Thereafter, a number of the prefabricated cylindrical members 20 are placed in rows so as to form a first supporting layer 12. The cylindrical members 20 in each row are joined together via the male and female connectors 40 and 42 and a connecting pin which passes through aligned portions of the caps 40 and 42. Each row extends in the intended direction of the roadway.

After at least a portion of the rows in the first layer 12 have been formed, connecting members 22 are positioned over upper surfaces of the cylindrical members 20 in the layer 12. Thereafter, a second layer 16 is formed by placing rows of preconnected cylindrical members 20 over the first layer 12. As previously discussed, the rows forming the second layer are positioned by the upper surfaces of the connecting members 22. The rows forming the second layer extend in a direction substantially perpendicular to the direction of the roadway.

After a portion of the second layer 16 has been formed, a plurality of roadbed panels 24 are positioned over the upper surfaces of the cylindrical members 20 forming the rows in the second layer 16. The roadbed panels 24 are formed into two spaced apart rows with each row extending in the intended direction of the roadway. The panels 24 are spaced apart a distance sufficient to allow vehicular travel to pass over the substantially planar upper surfaces 68 of the horizontal members 64.

If desired, panels formed from wood or metal may be placed over the upper surfaces 68 to further form the roadway.

Figure 10:
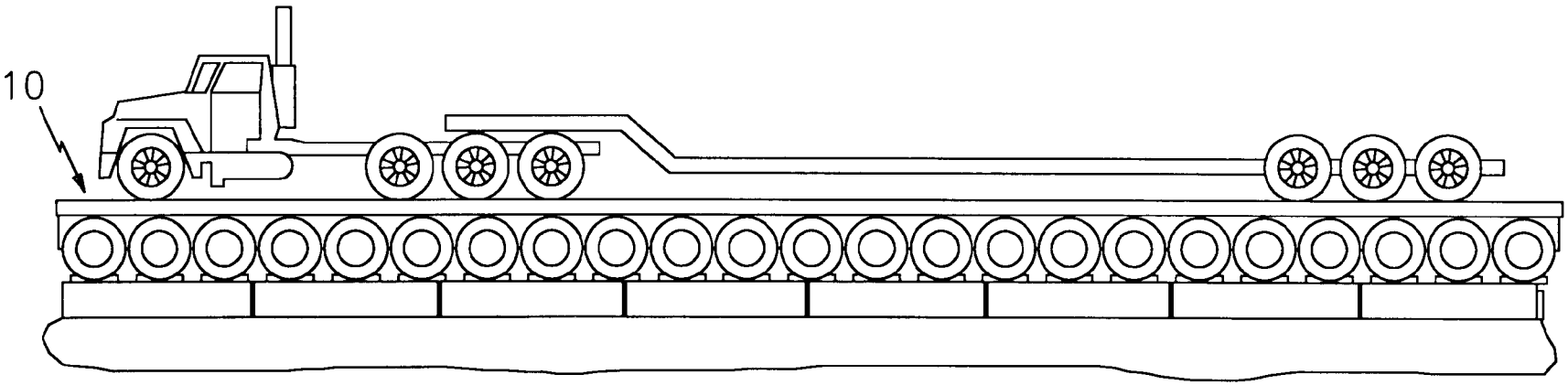
FIG. 10 is a side view of a roadway formed in accordance with the present invention.

A portion of a completed roadway in accordance with the present invention is shown in FIG. 10.

The roadway system of the present invention has a number of advantages. For example, it is relatively easy to install and to fabricate. This is due in part to the use of a minimal number of preformed components. Still further, the roadway of the present invention may be installed with minimal impact on the environment. There is no need to move large portions of earth or otherwise disturb the environment to form the roadway.

The roadway of the present invention has the advantage that it may be used over soft terrains including marsh-like ground. Since the roadway is principally formed from concrete, the environment will have minimal impact on the roadway support structures.

After the roadway formed in accordance with the present invention is no longer required, it may be easily disassembled and the components can be reused.

It has been found that roadways formed in accordance with the present invention are capable of supporting vehicles with very heavy loads. For examples, vehicles having loads up to 100 tons may travel over a roadway formed in accordance with the present invention.

While the present invention is intended to form temporary roadways, it should be recognized that the roadway system of the present invention can be used to form permanent roadways. Additionally, the preformed concrete components discussed herein may also be used to form other structures such as heliports or platforms needed to support heavy equipment.

While specific embodiments of the invention have been shown and described in detail to illustrate the application of the inventive principles, it will be understood that the invention may be embodied otherwise without departing from such principles.

What is claimed is:

1. A roadway for supporting vehicular traffic comprising:

a network of interconnected modular components forming means for supporting a road bed over which said vehicles can travel, said network of interconnected modular components includes a first layer of cylindrical members aligned in a first direction, a second layer of cylindrical members above said first layer and aligned in a second direction substantially perpendicular to said first direction a third layer intermediate said first and second layers, said third layer being formed by a plurality of noncylindrical connecting members having upper and lower cylindrical portions for receiving said second layer and said first layer of cylindrical members, respectively, for joining said cylindrical members in said second layer to said cylindrical members in said first layer; wherein said first layer of cylindrical members are arranged side by side in abutting relationship and said second layer of cylindrical members are arranged side by side in abutting relationship; and a plurality of panels forming said road bed overlaying said network of interconnected modular components.

2. The roadway according to claim 1 further comprising said panels forming said roadbed comprising two rows of laterally spaced panels, each of said panels having arcuate cut-out portions for mating with said cylindrical members in said second layer and a planar surface over which a vehicle can travel.

3. The roadway according to claim 2 further comprising a layer of stress diffusion material positioned intermediate said cylindrical members in said second layer and said arcuate surfaces on said panels forming said roadbed.

4. The roadway according to claim 1 wherein said first layer is formed by a plurality of rows of concrete, cylindrically shaped members joined together.

5. The roadway according to claim 4 further comprising each concrete cylindrically shaped member having an outer surface, an internal surface formed by reinforced steel wire mesh, at least one hexagonally shaped internal reinforcing member positioned within said bore, and concrete filling the spaces between said outer surface and sidewall portions of said at least one reinforcing member.

6. The roadway according to claim 5 further comprising each concrete cylindrical member in said first layer having a first cap with a female connector joined to a first end and a second cap with a male connector joined to a second end and said rows of cylindrical members being formed by joining adjacent ones of said cylindrical members with said male and female connectors.

7. The roadway according to claim 6 further comprising:

said first cap having two spaced apart notches and a diametrical passageway extending between said notches;

said second cap having connecting pieces with apertures incorporated therein; and said connecting pieces being insertable in said notches so as to align said apertures with said passageway so as to allow a connecting device to pass therethrough and join said adjacent cylindrical members together.

8. The roadway according to claim 5 further comprising said at least one hexagonally shaped internal reinforcing member has a plurality of internal web defining voids and at least one inflatable hose in each of said voids to prevent the ingress of water into said cylindrical member so as to render said cylindrical member substantially buoyant.

9. The roadway according to claim 4 further comprising means for supporting said second layer of cylindrical members attached to said cylindrical members forming said first layer.

10. The roadway according to claim 9 wherein said supporting means comprises rows of connectors attached to an upper surface of said cylindrical members of said first layer, each of said connectors having a first arcuate surface for mating with the exterior surface of one of said cylindrical members in said first layer and a second arcuate surface for mating with an exterior surface of one of said cylindrical members forming said second layer.

11. The roadway according to claim 4 wherein said second layer comprises rows of concrete cylindrical members, each row comprising at least two concrete cylindrical members joined together.

12. The roadway according to claim 11 further comprising:

each concrete cylindrical member in said second layer having an outer surface, an inner surface forming a circular bore, at least one hexagonally shaped internal reinforcing member positioned within said bore, spaces between said inner surface and side walls of said at least one reinforcing member, and concrete filling said spaces.

13. The roadway according to claim 11 further comprising:

two rows of roadbed panels positioned over said second layer;

each of said rows of roadbed panels extending along said first direction; and each of said panels forming said roadbed having a first surface having a planar upper surface and a lower surface with two arcuately shaped cut-out portions for mating with two rows of said cylindrical members forming said second layer.

14. The roadway according to claim 13 further comprising a stress diffusion material positioned between one of said arcuately shaped cut-out portions and an upper surface of a cylindrical member in one of said rows in said second layer.

15. The roadway according to claim 13 further comprising each of said panels having a vertically extending member having a lower surface which abuts said planar upper surface.

16. A method for constructing a roadway comprising:

prefabricating a plurality of cylindrical members said prefabricating step comprises providing a plurality of concrete tubes each having an outer surface, and an internal surface forming a cylindrical bore and inserting at least one reinforcing member within each said tube;

forming a first roadway support layer over a particular terrain to be traversed;

said first layer forming step comprising forming a plurality of rows of said prefabricated cylindrical members with each row extending in a first direction;

forming a second roadway support layer over said first roadway support layer;

said second layer forming step comprising forming a plurality of rows of said prefabricated cylindrical members which rows extend in a second direction substantially perpendicular to said first direction; and forming a roadbed over said second layer by forming two spaced apart rows of roadbed panels with each row extending in said first direction.

17. The method of claim 16 wherein said prefabricating step further comprises:

forming a plurality of first caps each having a female connecting portion, two spaced apart notches, and a passageway extending between said notches;

forming a plurality of second caps each having a male connecting member and two spaced apart connecting pieces each with an aperture therein; and joining one of said first and second caps to two opposed ends of each cylindrical member.

18. The method of claim 17 wherein said first layer row forming step comprises joining adjacent ones of said cylindrical members together by inserting said spaced apart connecting pieces of said second cap into said notches in said first cap and by mating said male connecting member with said female connecting member.

19. The method of claim 18 wherein said joining step further comprises passing a connecting device through said apertures in said connecting pieces and through said passageway in said first cap.

20. The method of claim 19 further comprising:

providing a plurality of support devices each having an arcuately shaped lower surface for mating with one of said cylindrical members in said first layer and an arcuately shaped upper surface for receiving one of said cylindrical members in said second layer; and placing said support devices over selected ones of said cylindrical members in said first layer.

21. The method of claim 20 wherein said second layer row forming step comprises joining two prefabricated cylindrical members together using said male and female connectors and said notches and said connecting pieces.

22. The method of claim 21 further comprising providing stress diffusion material between upper surfaces of said cylindrical members forming said second layer and said panels forming said roadbed.

* * * * *